US006132263A

United States Patent [19]

Wu

[11] Patent Number: 6,132,263

[45] Date of Patent: Oct. 17, 2000

[54] HARD DISK DRIVE CONNECTOR

[75] Inventor: Jerry Wu, Chang-Hua, Taiwan

[73] Assignee: Hon Hai Precision Ind. Co., Ltd., Taipei Hsien, Taiwan

[21] Appl. No.: 09/371,465

[22] Filed: Aug. 10, 1999

[51] Int. Cl.[7] ..... H01R 13/41

[52] U.S. Cl. ..... 439/752.5; 439/733.1

[58] Field of Search ..... 439/79, 733.1, 439/752.5

[56] References Cited

U.S. PATENT DOCUMENTS

| | | | |
|---|---|---|---|
| 4,286,837 | 9/1981 | Yasutake et al. | 439/733.1 |
| 4,317,609 | 3/1982 | Lapraik | 439/733.1 |
| 4,717,354 | 1/1988 | McCleerey | 439/733.1 |
| 5,152,700 | 10/1992 | Bogursky et al. | 439/733.1 |
| 5,286,218 | 2/1994 | Sakurai et al. | 439/733.1 |
| 5,549,480 | 8/1996 | Cheng | 439/733.1 |
| 5,586,915 | 12/1996 | Baker et al | 439/733.1 |
| 5,641,314 | 6/1997 | Broschard, III et al. | 439/733.1 |

*Primary Examiner*—Gary F. Paumen
*Attorney, Agent, or Firm*—Wei Te Chung

[57] ABSTRACT

A hard disk drive connector includes an insulative housing defining passages for receiving and retaining contacts. Each passage is defined by opposite side walls. Opposite notches are defined in the side walls in communication with the passage. Each contact includes a U-shaped body received in the corresponding passage and a pair of pre-loaded, resilient fingers extending from the body for receiving therebetween and engaging with a corresponding pin of a hard disk drive. A retention section is formed on the body of each contact and has opposite edges interferentially received in the notches for firmly and stably retaining the contact in the passage. Each retention section forms shoulders for abutting against stop surfaces formed in the notches thereby properly positioning the contact in the passage. A tail section extends from the retention section and beyond the housing for being soldered to a circuit board. A spacer is formed on the housing and defines slots for interferentially receiving and retaining the tail sections therein. A pair of support arms extends from the body of each contact and tightly abuts against the side walls of the corresponding passage for stably supporting the contact in the passage. Barbs are formed on the body of the contact for interferentially engaging with walls of the corresponding passage thereby fixing the contact therein.

1 Claim, 7 Drawing Sheets

HARD DISK DRIVE CONNECTOR

BACKGROUND OF THE INVENTION

1. Field of the Invention

The present invention generally relates to an electrical connector for connecting a hard disk drive (HDD) to a circuit board, and in particular to a contact of an HDD connector which is firmly secured in a housing of the connector.

2. The Prior Art

An HDD connector is mounted to a circuit board and is engageable with an HDD for establishing electrical connection between the HDD and the circuit board. A conventional housing of an HDD connector defines upper and lower rows of passages for receiving first and second contacts therein. Each contact has a tail section bent toward a circuit board for being soldered to the circuit board. A force is exerted on the contact during the bending operation whereby an undesired displacement of the contact with respect to the housing occurs and the securement of the contact in the housing becomes unstable.

In addition, in a surface-mounted HDD connector, a soldering portion of the tail of each contact is bent to be substantially parallel to a circuit board to which the connector is mounted. Due to mechanical properties of the contact, partial spring-back of the bent area of the contact occurs when the bending force is released, causing the soldering portion to be improperly aligned with the circuit board. Furthermore, warpage of the housing which frequently occurs in an injection-molded portion enhances the problem.

It is thus desirable to provide an HDD connector for addressing the problems discussed above.

SUMMARY OF THE INVENTION

Accordingly, an object of the present invention is to provide an HDD connector comprising contacts firmly secured in a housing thereof for resisting bending forces applied thereto.

Another object of the present invention is to provide an HDD connector comprising contacts stably fixed in a housing thereof.

A further object of the present invention is to provide an HDD connector comprising a spacer for securely retaining tails of contacts thereof in position and maintaining perfect alignment of the tails.

Still a further object of the present invention is to provide an HDD connector comprising stop means for properly positioning contacts thereof with respect to a housing.

To achieve the above objects, an HDD connector in accordance with the present invention comprises an insulative housing defining passages for receiving and retaining contacts. Each passage is defined by opposite side walls. Opposite notches are defined in the side walls in communication with the passage. Each contact includes a U-shaped body received in the corresponding passage and a pair of pre-loaded, resilient fingers extending from the body for receiving therebetween and engaging with a corresponding pin of a hard disk drive. A retention section is formed on the body of each contact and has opposite edges interferentially received in the notches for firmly and stably retaining the contact in the passage. Each retention section forms shoulders for abutting against stop surfaces formed in the notches thereby properly positioning the contact in the passage. A tail section extends from the retention section and beyond the housing for being soldered to a circuit board. A spacer is formed on the housing and defines slots for interferentially receiving and retaining the tail sections therein. A pair of support arms extends from the body of each contact and tightly abuts against the side walls of the corresponding passage for stably supporting the contact in the passage. Barbs are formed on the body of the contact for interferentially engaging with walls of the corresponding passage thereby fixing the contact therein.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
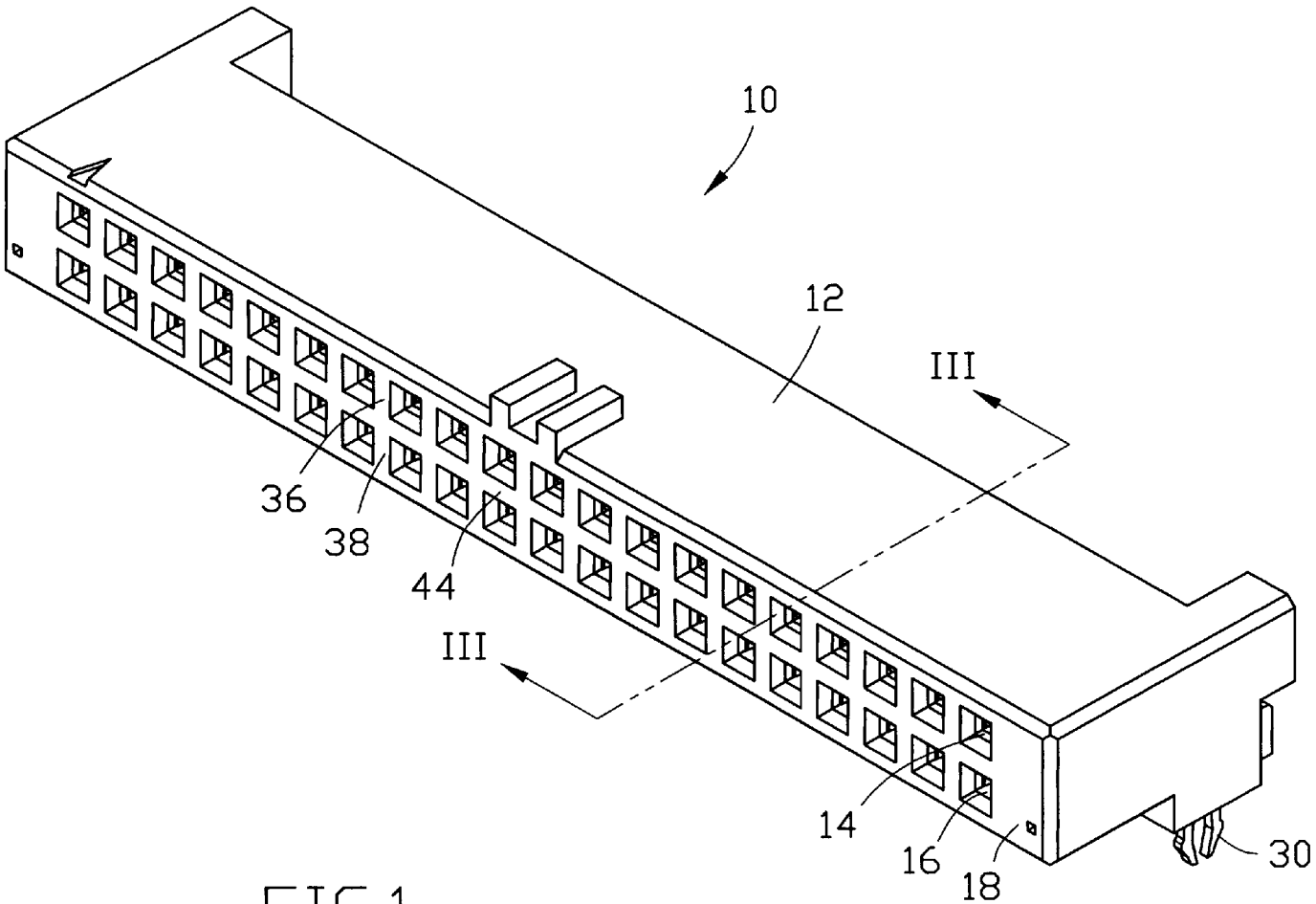
FIG. 1 is a perspective view of an electrical connector constructed in accordance with the present invention.
Figure 2:
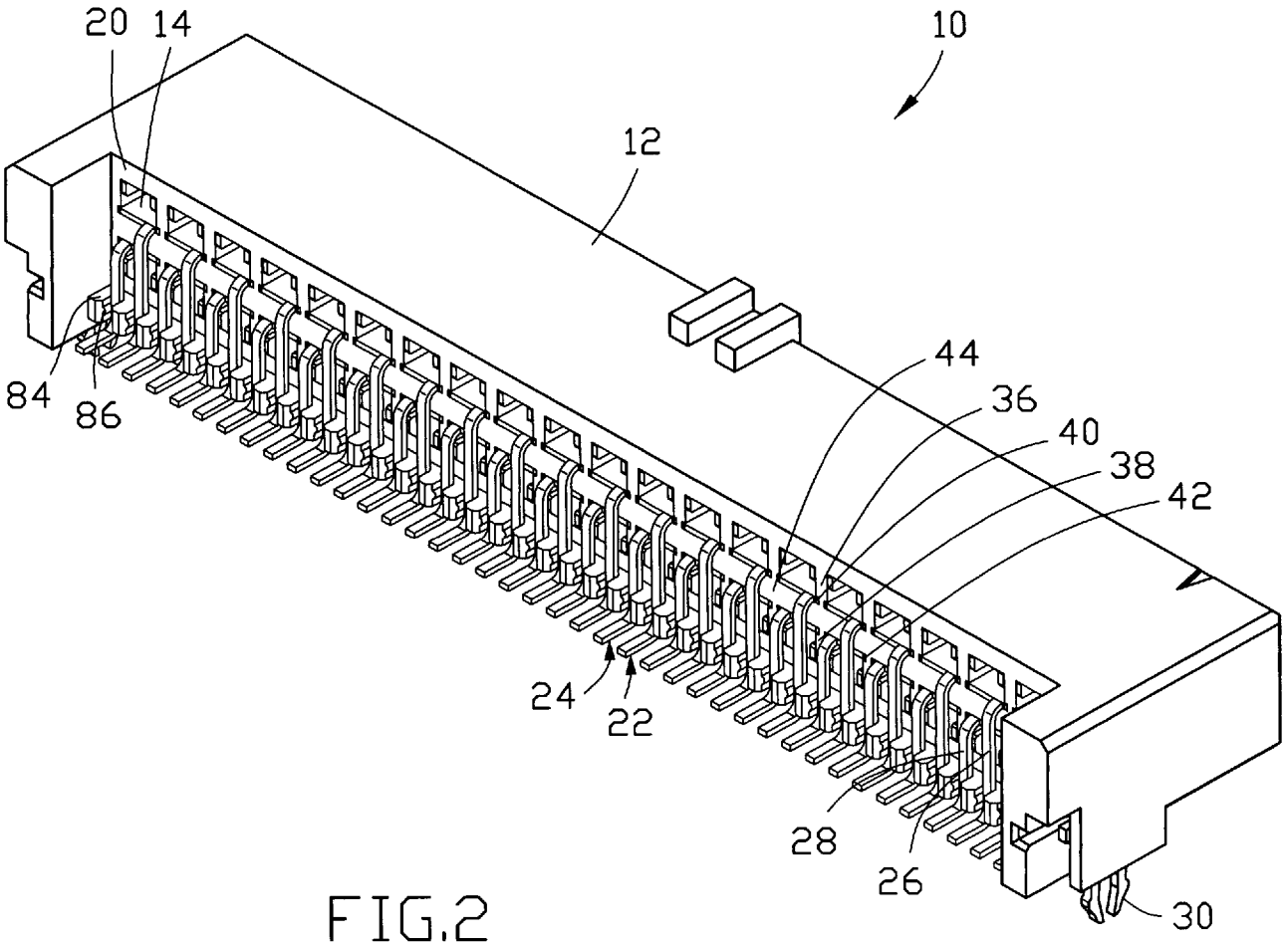
FIG. 2 is similar to FIG. 1 but taken from a different angle.
Figure 3:
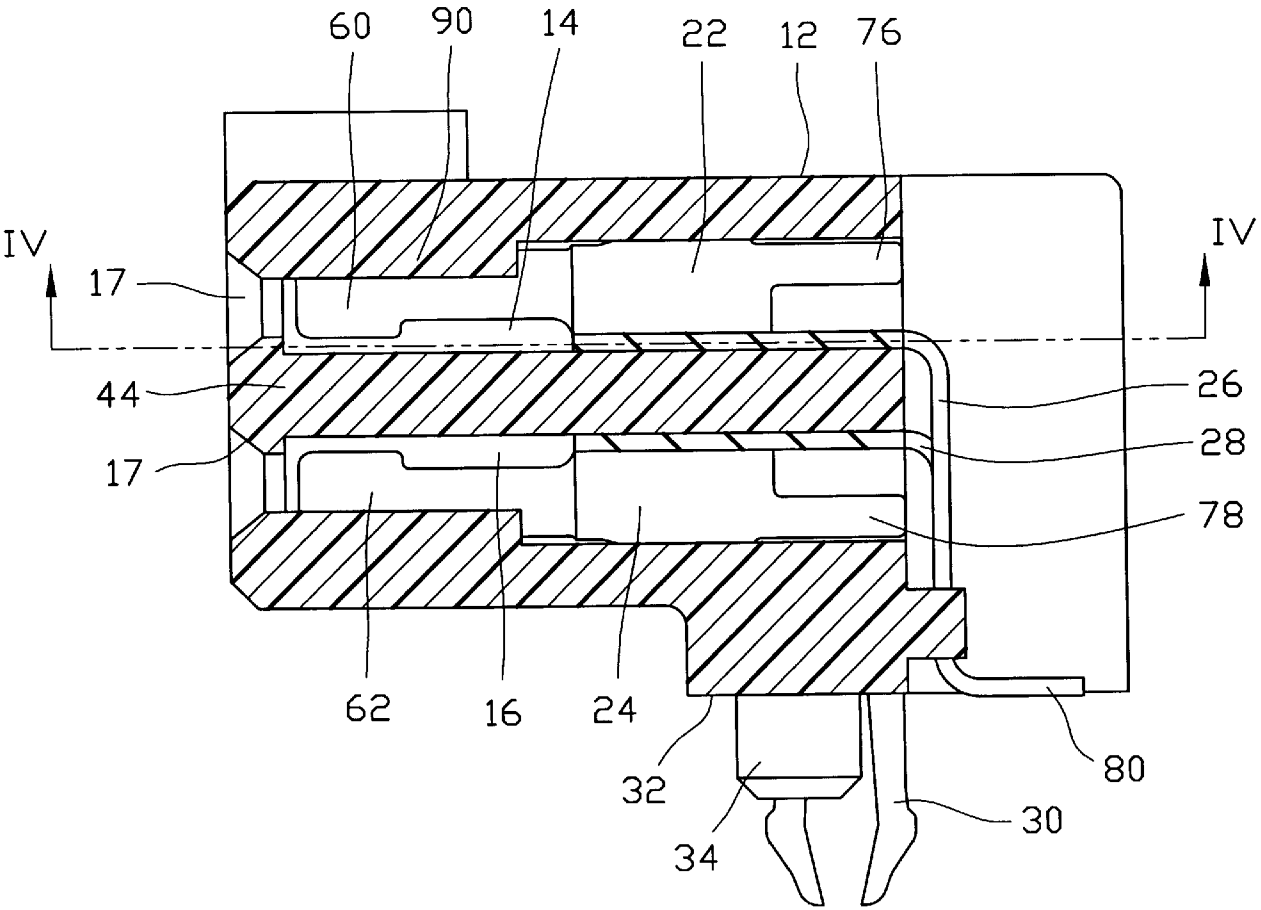
FIG. 3 is a cross-sectional view taken along line III—III of FIG. 1.

Referring to the drawings and in particular to FIGS. 1–3, a hard disk drive (HDD) connector 10 in accordance with the present invention comprises an insulative housing 12 defining a row of first passages 14 and a row of second passages 16 substantially parallel to each other. The passages 14, 16 extend between front and rear faces 18, 20 of the housing 12 for receiving and retaining first and second conductive contacts 22, 24 therein, respectively. The passages 14, 16 form conical openings 17 in the front face 18 for the insertion of corresponding pins of an HDD (not shown). The contacts 22, 24 comprise tail sections 26, 28 extending beyond the rear face 20 for being soldered to a circuit board (not shown). Board locks 30 are mounted on opposite ends of the housing 12 and extend beyond a bottom face 32 thereof for engaging with corresponding holes defined in the circuit board to retain the HDD connector 10 thereon. Positioning posts 34 are formed on the bottom face 32 of the housing 12 for properly positioning the HDD connector 10 on the circuit board.

Figure 4:
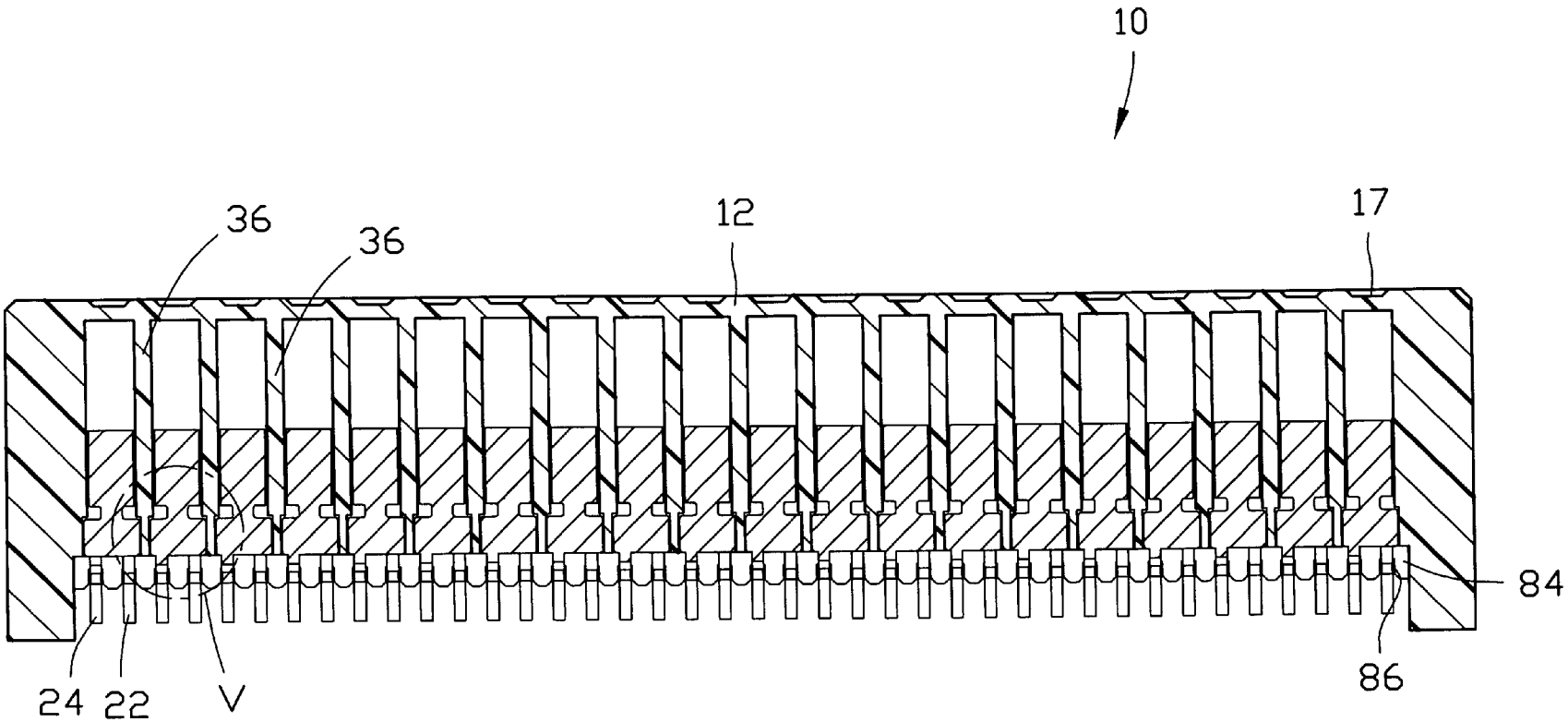
FIG. 4 is a cross-sectional view taken along line IV—IV of FIG. 3.
Figure 5:
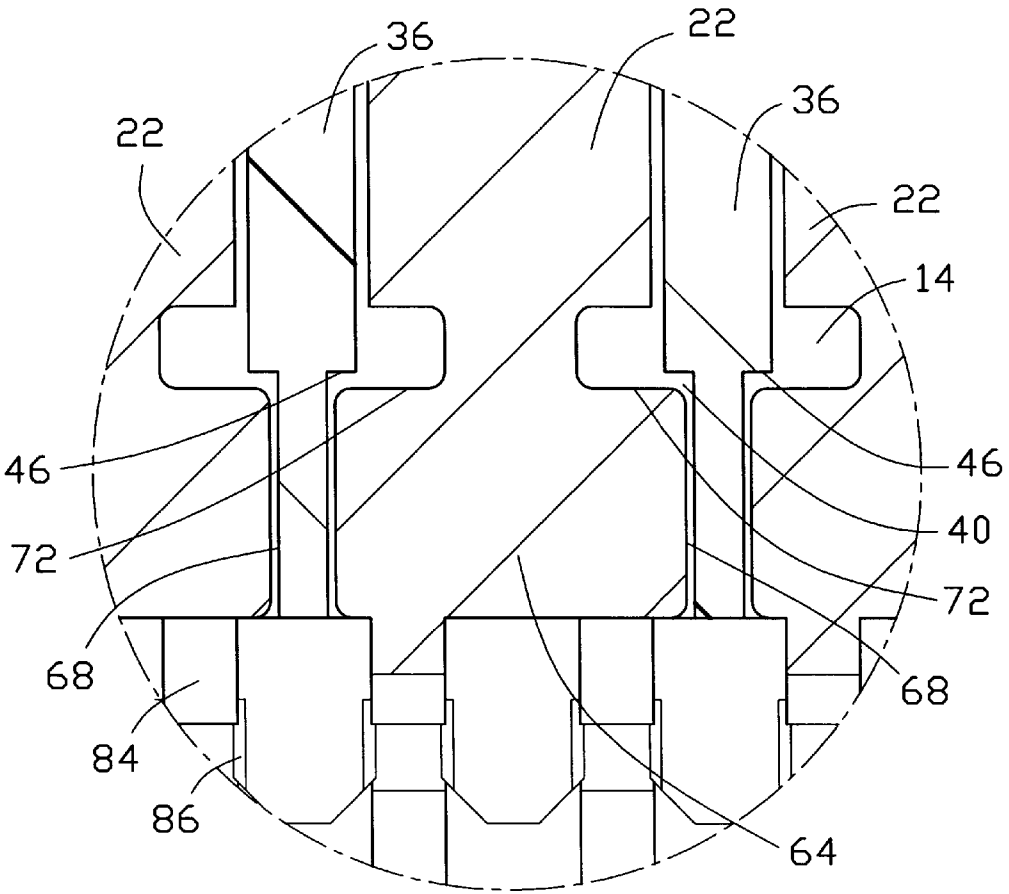
FIG. 5 is an enlarged view of encircled portion V of FIG. 4.

Also referring to FIGS. 4 and 5, each passage 14, 16 is defined by opposite side walls 36, 38 each defining a notch 40, 42 in communication with the corresponding passage 14, 16. In the embodiment illustrated, each first passage 14 corresponds to one second passage 16 and a partition 44 is formed therebetween. The notches 40, 42 of the first and second passages 14, 16 are arranged proximate the partition 44. Each first notch 40 forms a stop surface 46 in the first passage 14. Similarly, each second notch 42 forms a stop surface (not shown) in the second passage 16.

Figure 6:
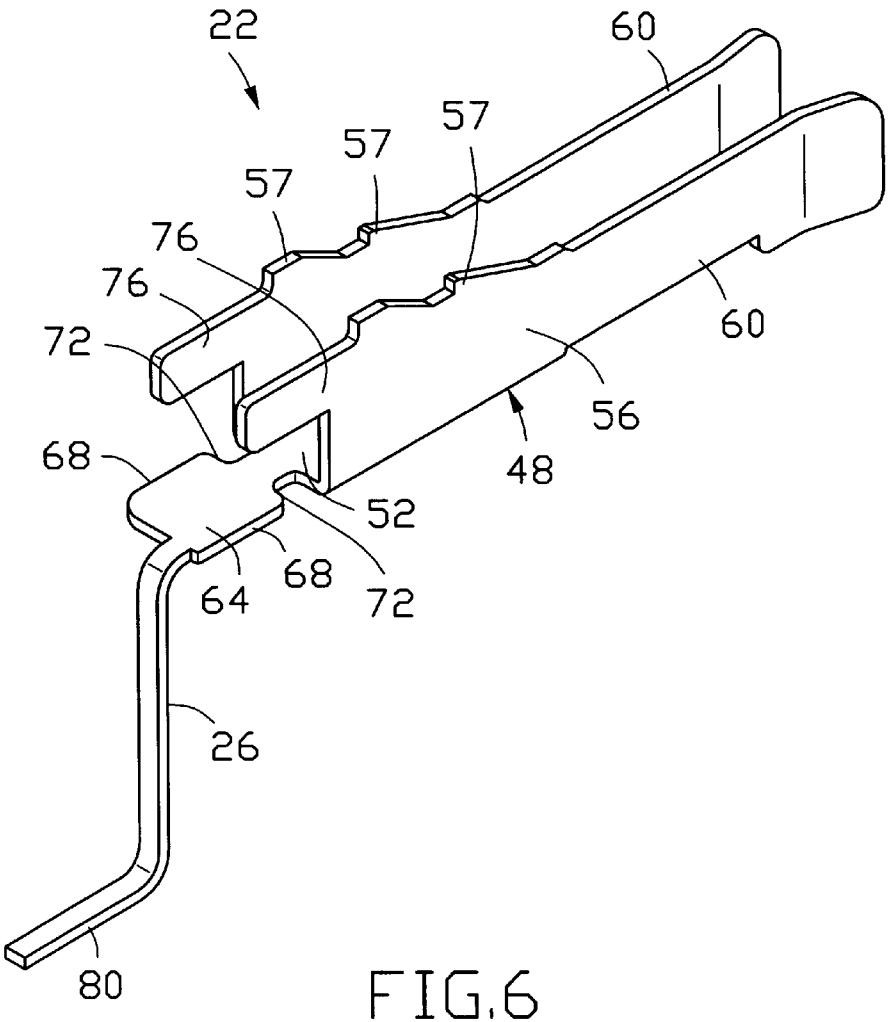
FIG. 6 is a perspective view of a first contact of the electrical connector of the present invention.
Figure 7:
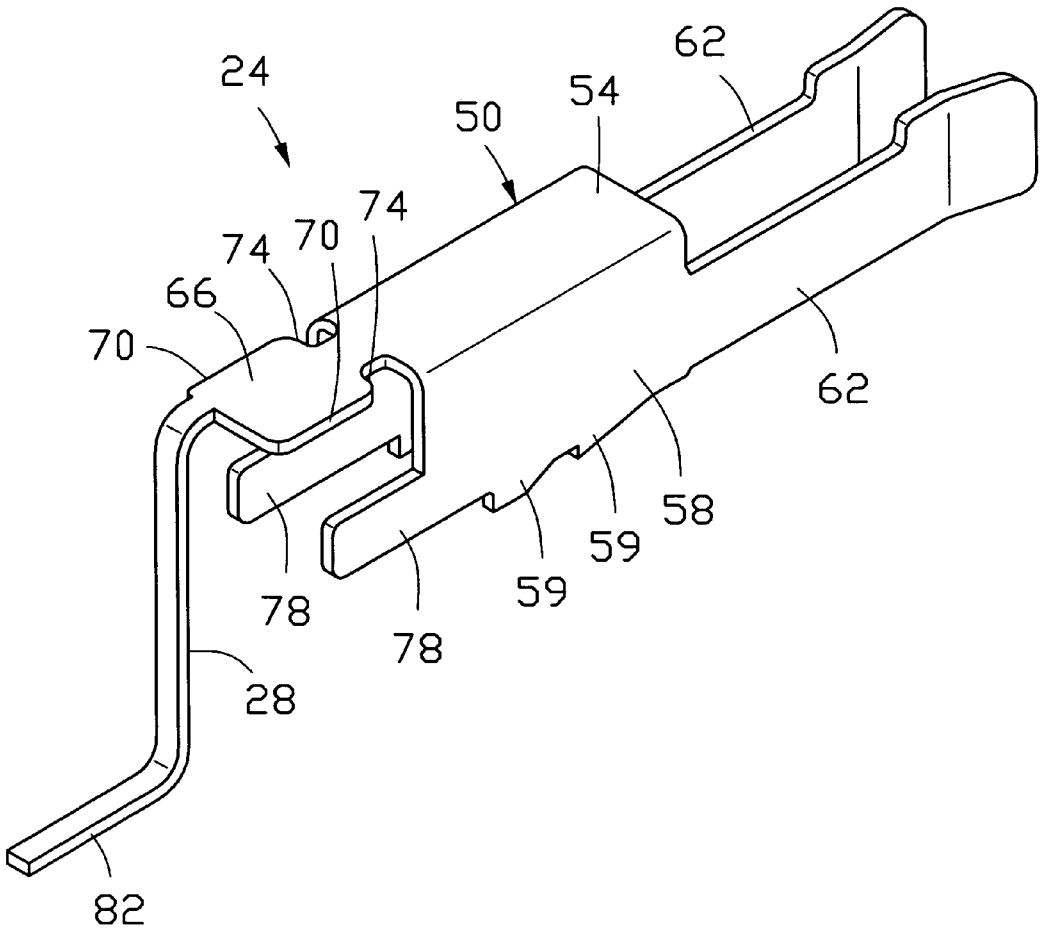
FIG. 7 is a perspective view of a second contact of the electrical connector of the present invention.

Also referring to FIGS. 6 and 7, each contact 22, 24 comprises a U-shaped body 48, 50 having a central portion 52, 54 and two side portions 56, 58. The contacts 22, 24 are inserted into the corresponding passages 14, 16 with the side portions 56, 58 thereof abutting against the side walls 36, 38 of the corresponding passages 14, 16. Barbs 57, 59 are formed on edges of the side portions 56, 58 for interferentially engaging with inside faces of the corresponding passage 14, 16 thereby securing the contacts 22, 24 in the passages 14, 16. Each contact 22, 24 comprises a pair of resilient fingers 60, 62 extending from the side portions 56, 58 of the body 48, 50 toward the front face 18 of the housing 12 and converging toward each other for engagingly receiving the corresponding pin of the HDD therebetween. Each tail section 26, 28 extends from the central portion 52, 54 of the main body 48, 50 beyond the rear face 20 of the housing 12, in a direction opposite the fingers 60, 62.

A retention section 64, 66 is formed between the central portion 52, 54 and the tail section 26, 28 and has opposite edges 68, 70 interferentially received in the notches 40, 42 of the corresponding passage 14, 16 for firmly retaining the contact 22, 24 therein. Each retention section 64, 66 forms shoulders 72, 74 for abutting against the stop surfaces 46 formed inside the corresponding passage 14, 16 (FIG. 5) for properly positioning the contact 22, 24 therein. It should be noted that the shoulders 72 are shown to be slightly distanced from the stop surfaces 46 for illustration purposes. A projection 90 (FIG. 3) is formed in each passage 14, 16 for separating the corresponding fingers 60, 62 from each other and pre-loading the fingers 60, 62 when the contact 22, 24 is inserted into the passage 14, 16.

Two support arms 76, 78 extend from the side portions 56, 58 of the main body 48, 50 of each contact 22, 24 in a direction substantially opposite the fingers 60, 62. The support arms 76, 78, serving as extensions of the side portions 56, 58 of the main body 48, 50, firmly abut against the side walls 36, 38 of the corresponding passage 14, 16 for securely retaining the contact 22, 24 therein.

The tail section 26, 28 of each contact 22, 24 is bent 90 degrees for extending toward and being soldered to the circuit board to which the connector 10 is mounted. During the bending operation, a force is exerted on each contact 22, 24 causing undesired displacement thereof with respect to the housing 12. With the edges 68, 70 of the retention section 64, 66 of each contact 22, 24 retained in the corresponding notches 40, 42 of the housing 12, the retention section 64, 66 provides resistance against the bending force exerted on the contact 22, 24 thereby effectively eliminating or alleviating undesired displacement thereof In the embodiment illustrated, each tail section 26, 28 comprises a soldering section 80, 82 substantially parallel to and aligned with the bottom face 32 of the housing 12 for being surface mounted to the circuit board. However, the soldering section 80, 82 may be substantially perpendicular to the bottom face 32 for being soldered to the circuit board by a through-hole technique.

Referring to FIGS. 2 and 4, a spacer 84 is formed on the rear face 20 of the housing 12 and defines a plurality of spaced slots 86 for interferentially receiving the tail sections 26, 28 of the contacts 22, 24 thereby securely retaining the tail sections 26, 28 in position and effectively preventing the bent portion from springing back to its original position. For surface mounting the connector 10 to the circuit board, perfect alignment of the soldering sections 80, 82 is of vital importance. The spacer 84 securely retains the tail sections 26, 28 thereby effectively maintaining the alignment of the soldering sections 80, 82.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electrical connector comprising:

an insulative housing defining passages between front and rear faces thereof, each passage being defined by opposite side walls of the housing and each side wall forming a notch in communication with the corresponding passage; and conductive contacts received and retained in the passages, each contact comprising a U-shaped body having a central portion and opposite side portions, a pair of resilient fingers extending from the side portions toward the front face of the housing and converging toward each other, a retention section formed on the central portion, a tail extending from the retention section and beyond the rear face of the housing and adapted to be soldered to a circuit board, the retention section having opposite edges received and retained in the corresponding notches thereby firmly retaining the contact in the corresponding passage;

wherein the edges of the retention section of each contact are interferentially retained in the corresponding notches of the housing;

wherein each notch has a stop surface, and wherein the retention section of each contact has shoulders abutting against the stop surfaces of the corresponding notches for properly positioning the contact in the passage;

wherein two support arms extend from the side portions of the main body of each contact, the support arms tightly engaging with the side walls of the corresponding passage for stably supporting the contact in the corresponding passage;

wherein a spacer is formed on the rear face of the housing and defines a plurality of spaced slots for interferentially receiving and thus retaining the tails of the contacts therein;

wherein barbs are formed on the side portions of the main body of each contact for interferentially engaging with walls of the corresponding passage;

wherein a projection is formed in each passage for separating the fingers from each other thereby pre-loading the fingers;

further comprising board locks mounted to a bottom face of the housing;

further comprising positioning posts formed on a bottom face of the housing;

wherein the housing has two parallel rows of the passages;

wherein the two rows of passages are separated by a partition, and wherein the central portion of each contact is positioned to abut against the partition.

* * * * *